United States Patent [19]

Mainka et al.

[11] 3,998,148

[45] Dec. 21, 1976

[54] PRESS FOR SUGAR BEET AND SIMILAR CHIPS

[75] Inventors: Helmut Mainka, Wolfenbuttel; Hans Schmidt, Heimerode; Günther Grosshennig, Essen, all of Germany

[73] Assignee: Salzgitter Maschinen Aktiengesellschaft, Salzgitter, Germany

[22] Filed: Dec. 18, 1974

[21] Appl. No.: 534,351

[30] Foreign Application Priority Data

Dec. 22, 1973 Germany ..... 2364292

[52] U.S. Cl. ..... 100/117; 100/150

[51] Int. Cl.[2] ..... B30B 9/12

[58] Field of Search ..... 100/117, 145, 146, 147, 100/148, 149, 150, 37

[56] References Cited

UNITED STATES PATENTS

| | | | |
|---|---|---|---|
| 3,009,412 | 11/1961 | Jung | 100/150 X |
| 3,035,511 | 5/1962 | Hayes | 100/148 X |
| 3,478,679 | 11/1969 | Bauserman | 100/150 X |
| 3,780,645 | 12/1973 | Farmer | 100/147 |

FOREIGN PATENTS OR APPLICATIONS

| | | | |
|---|---|---|---|
| 560,184 | 5/1931 | Germany | |
| 65,194 | 1/1969 | Germany | 100/117 |
| 845,356 | 8/1960 | United Kingdom | |
| 1,045,744 | 10/1966 | United Kingdom | |

*Primary Examiner*—Peter Feldman
*Attorney, Agent, or Firm*—Michael J. Striker

[57] ABSTRACT

A rotatable pressing spindle is mounted in a housing which surrounds it and which has an upper section, a lower section and a middle section. The middle section includes a self-supporting outer jacket and a tubular screen received with radial clearance in the outer jacket. Mounting elements are provided on the outer jacket, extending inwardly thereof and mounting the screen on the outer jacket, and connecting elements connect the outer jacket with the upper and lower housing sections, respectively. Other features are also disclosed.

12 Claims, 10 Drawing Figures

Fig. 1
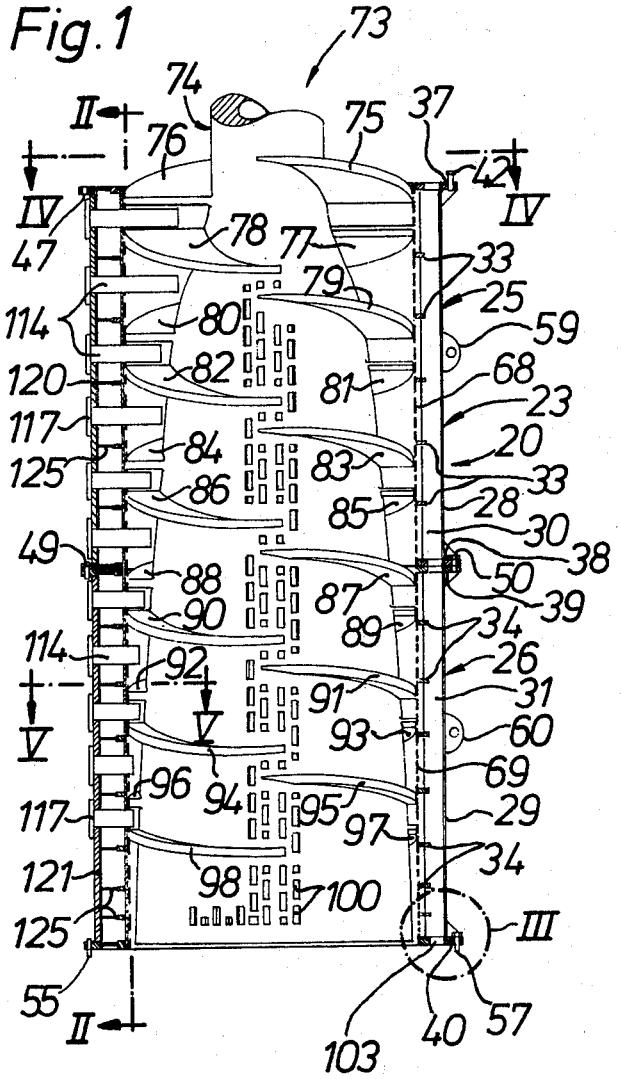
Fig. 2
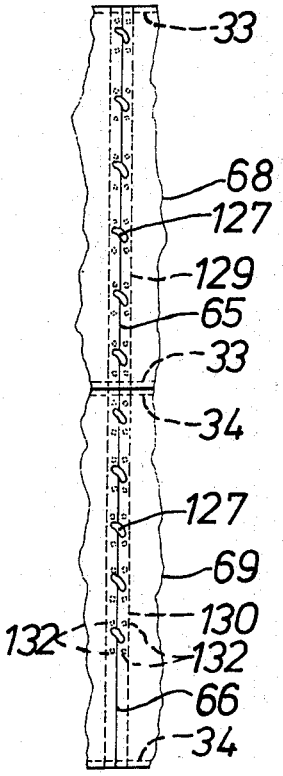
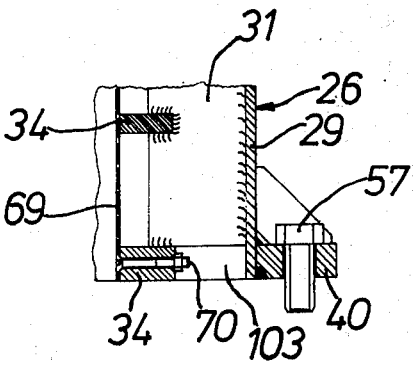
Fig. 3

Fig. 4
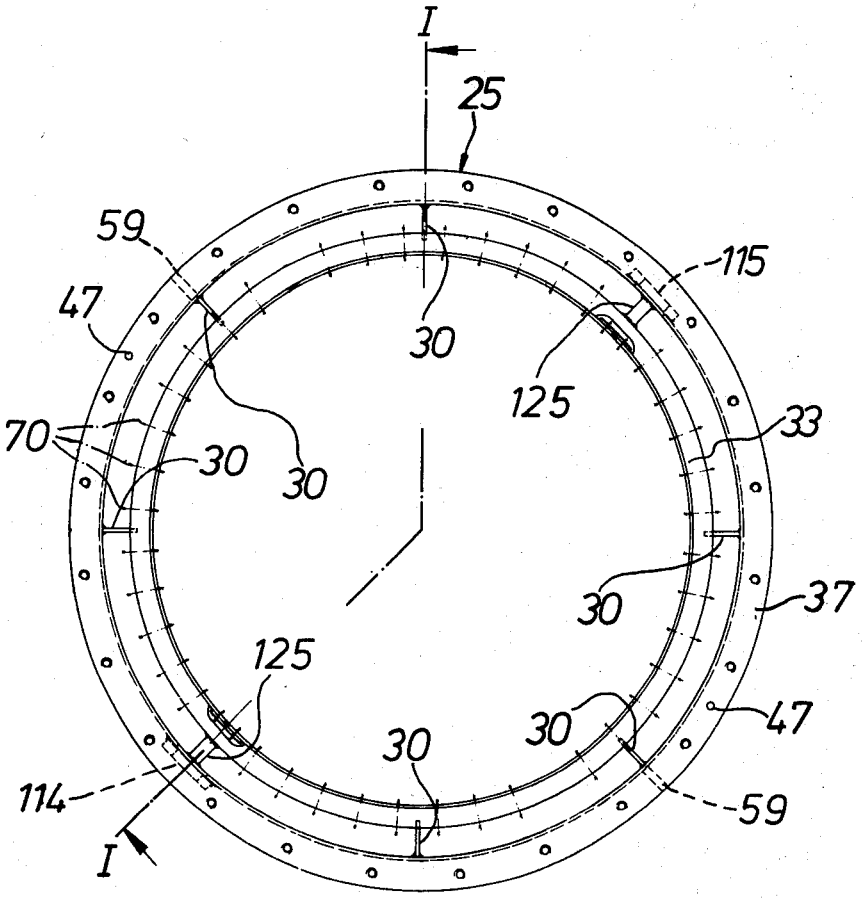
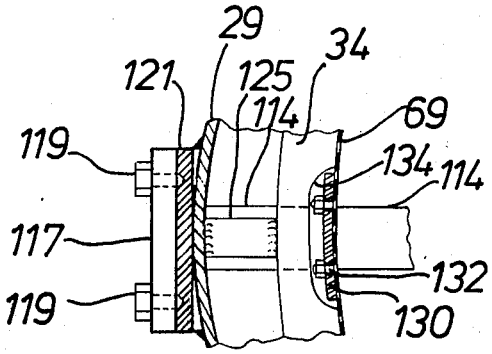
Fig. 5

PRESS FOR SUGAR BEET AND SIMILAR CHIPS

BACKGROUND OF THE INVENTION

The present invention relates generally to a press, and more particularly to a press for sugar beet and similar chips.

It is known to provide presses of this type wherein a rotary press spindle is mounted in a housing and the chips to be pressed and to have liquid extracted from them are admitted into the housing and are subjected to pressing by the rotating pressing spindle. Such devices have an inner tubular screen which, according to one teaching of the prior art, is a self-supporting element on which flow-retarding members are mounted that cooperate with feed vanes on the rotating press spindle to retard the flow of the beet chips or other chips through the press. The housing has a center portion, an upper portion and a lower portion; the center portion is supported on the lower portion which is suspended on devices that are distributed about its circumference and which, in turn, are mounted on a sole plate in the region of the plane of separation between the center portion and the upper portion of the housing, so that the housing is fully suspended. The upper portion of the housing is itself supported on the sole plate. The tubular screen is divided in transverse direction approximately midway between its ends, and each of the two parts of the screen that are thus obtained is divided in longitudinal direction.

This prior-art construction is complicated and expensive, especially because four separate shell portions are required for the tubular screen, two for each of the axial sections thereof. These are very difficult to install relative to the pressing spindle with the necessary accuracy. In this case it must be kept in mind that the screen should be spaced from the pressing spindle at all locations by approximately 1 mm, which is very difficult to do for screen sections. The outer jacket surrounding the screen is composed of a plurality of parts that are connected and it is not self-supporting. These parts also must be connected and adjusted relative to one another with great care, aside from requiring substantial care and time in their individual manufacture.

SUMMARY OF THE INVENTION

Accordingly, it is an object of this invention to overcome the disadvantages of the prior art.

A more particular object of the invention is to provide an improved press of the type in question in which a heavy housing can be produced and erected in a substantially simpler and less expensive manner than before.

In keeping with these objects, and with others which will become apparent hereafter, one feature of the invention resides in a press for sugar beet and similar chips which comprises a rotatable pressing spindle, a housing surrounding the pressing spindle and having an upper section, a lower section, and a middle section which includes a self-supporting outer jacket and a tubular screen received with radial clearance in the outer jacket. Mounting elements on the outer jacket extend inwardly thereof and mount the screen on the outer jacket, and means are provided for connecting the outer jacket with the upper and lower housing sections, respectively.

This results in a very strong and stiff self-supporting construction which can be readily reproduced from machine to machine, and which can also be produced without any great difficulty. This makes possible the ready exchange and replacement of parts of the housing. All parts of the press are advantageously of non-rusting steel. The shaft and/or the screw flight-like blades of the pressing spindle may be permeable to the liquid pressed from the chips.

A further object of the invention is to provide an improved press of the type in question which avoids still other difficulties of the prior art. In particular, the prior art proposes that the press housing and a separate housing for the drive which rotates the pressing spindle are each separately mounted on a sole plate or on an annular frame. This requirement involves considerable difficulties in the erection of such a press. The drive housing is complicated because it supports a centrally mounted inlet funnel for the chips. The drive shaft for the pressing spindle carries an annulus of gear teeth which usually rotates in an oil bath and which must be sealed with sealing rings relative to the sole plate and relative to the inlet funnel; these seals which usually have a rather large diameter cause difficulties in operation. The installation and removal of the pressing spindle is difficult in this construction.

One of the features of the present invention is, therefore, also to provide an improved press of the type in question in which the drive and the mounting of the pressing spindle are both simplified, and the mounting and dismounting of the pressing spindle is simpler than before.

In keeping with these objects, the invention provides, in a press of the type in question, a combination which comprises a press housing, a rotatable pressing spindle journalled in the press housing and having an outwardly extending end portion, and drive means for the spindle including a separate drive housing into which the end portion projects. Connecting means releasably connects the drive housing with the press housing. A bearing is carried by the drive housing, and a hub having a flange including a gear having an annulus of gear teeth, are both provided on the end portion. At least one of the hub and flange is supported by the bearing.

With this construction, the separate drive housing can readily be removed from the press housing on which it is mounted and can be equally readily reinstalled thereon. The entire bearing support for the inlet end where the chips are admitted is provided in the drive housing and is, therefore, readily accessible for examination and servicing or replacement. The lubricating of the bearing is also greatly simplified and the danger that lubricant might enter the press housing is reduced.

The bearing may be a combined radial and thrust bearing which acts in both axial directions, and may engage that side of the gear which faces away from the annulus of gear teeth. Thus, the gear serves for radial and axial support of the pressing spindle, thereby simplifying both the manufacture and the installation of the press.

Another concept of the invention involves the provision of a novel and improved press of the type in question which avoids still further disadvantages of the prior art. Such disadvantages involve the configuration of an end portion of the press spindle of a prior-art machine, as a frustoconical part of the press spindle, or else to so configurate the shaft of the press spindle parabolically that over its length it has a pitch corresponding to a self-retarding action. In neither of these cases will the pressing effectiveness of the apparatus be as good as is desired. Normally, a mash is admitted into such a press containing liquid and between 7–10% of dry substance, i.e., sugar beet or other chips. At best, the known spindle presses of the prior art are capable of pressing the mash to reduce the chips to about 20% of dry substance. It is, therefore, customary to dry the pressed-out chips until approximately 88% dry substance is obtained, whereupon they are pelletized and used as animal fodder.

According to another object of the invention, which is intended to overcome the disadvantages just outlined, the novel press according to the present invention is intended to be able to improve the effectiveness with which liquid is pressed from the chips, and to thereby also save the energy previously required for drying the pressed-out chips before they can be further processed to make animal fodder. In keeping with this object, a feature of the invention resides, in a press of the type in question, in a combination which comprises a press housing having a circumferential wall and being provided with a chip inlet and an axially spaced outlet. A rotatable pressing spindle is journalled for rotation in the housing and is spaced over its entire length from the circumferential wall. The spindle has a first part of circular cross section in the region of the inlet, and a second part which extends from the first part towards the outlet and increases in diameter in direction towards the latter. The second part has in direction from the first part towards the outlet a concave portion that is followed by a convex portion which, in turn, is followed by outwardly bowed portion.

This construction has advantages which achieve the aforementioned object. On the one hand, the chips as they pass the bowed portion are subjected to a differentiated pressing effect in accordance with certain technological requirements. The outwardly bowed configuration makes possible an early and energetic compressing of the chips, and from the bowed portion to the outlet the increase in the compression effect is to taper off more slowly than in the prior art. This is obtained by the relatively slight outward bowing of the bowed portion, so that over a relatively long period of time a relatively high pressing effect upon the chips is maintained, giving the expressed liquid sufficient time for running off out of the chips. This is based upon the observation that the major portion of the expressed liquid runs off rather quickly under pressure. The influencing of the compression relationships in the region of the outwardly bowed portion assures that the subsequent final pressing to which chips are subjected will be greater than was previously the case, without requiring separate devices or measures for this purpose. On the other hand, the invention assures that the advantageous inlet conditions for the mash in the region of the first part of the spindle exist as they do in the prior-art presses of this type.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a fragmentary diagrammatic axial section taken on line I—I of FIG. 4, and showing a center portion of one embodiment of the press;

FIG. 2 is a fragmentary side view of FIG. 1, as seen from the line II—II;

FIG. 3 is an enlarged detail view showing detail III of FIG. 1;

FIG. 4 is a view of FIG. 1 taken on line IV—IV but with the pressing spindle omitted;

FIG. 5 is a fragmentary sectional detail view on line V—V of FIG. 1 and on an enlarged scale;

DESCRIPTION OF THE PREFERRED EMBODIMENTS

Figure 7:
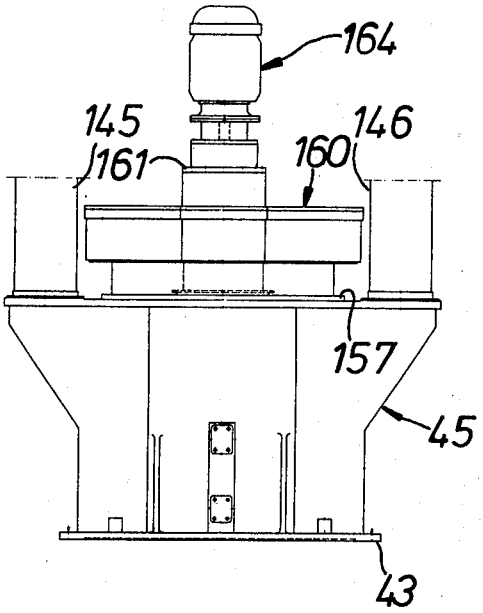
FIG. 7 is a view of FIG. 6 as seen from line VII—VII.

Discussing the drawing in detail, and referring firstly to the embodiment illustrated in FIGS. 1–5, it will be seen that reference numeral 20 identifies the housing of a press for sugar-beet chips or other similar chips. The housing has a center portion 23 which is composed of two axially registering sections 25 and 26 each having an outer jacket 28, 29, respectively, on which there are provided mounting members 30 and 31 which are spaced from one another and extend parallel to the longitudinal axis of the housing 20. The mounting members 30, 31 carry axially spaced circumferentially complete mounting rings 33 and 34, respectively. The sections 25, 26 are provided at their axial ends with flanges 37, 38, 39 and 40, which have planar contact faces.

Figure 6:
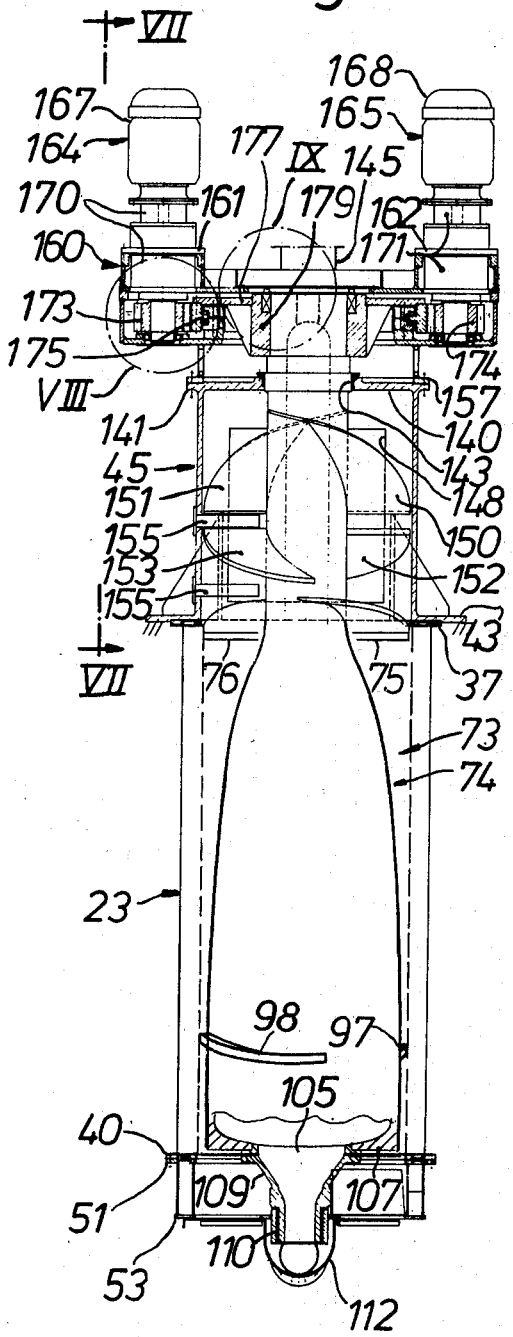
FIG. 6 is a vertical section through a spindle press according to a further embodiment of the invention.

The flange 37 is placed against a flange 43 of an upper housing part 45 shown in FIG. 6 and is connected thereto by means of screws 42. The centering between the flanges 37 and 43 is obtained by means of two non-illustrated centering pins on the flange 43 which engage into complementary centering holes 47 of the flange 37; the relationship could, of course, be reversed. The flanges 38 and 39 are similarly centered by centering pins 49 and are connected with one another by means of screws 50. The flange 40 of the section 26 abuts a flange 51 of a lower housing portion 53 that is shown in FIG. 6; centering is obtained by means of centering pins 55. It should be understood that the centering pins and their associated centering holes are shown circumferentially offset in FIG. 1; their actual circumferential relationship will be found in FIG. 4 from which it will be clear that they are axially aligned with the holes 47.

Screws 57 connect the section 26 to the lower housing portion 53. The jackets 28, 29 have welded mounting sprockets 59 and 60 which are spaced over their periphery and which can be engaged by a crane hook or the like for mounting and dismounting purposes.

Each of the sections 25, 26 has loosely supported on the rings 33, 34 a tubular screen 68 and 69, respectively, which is divided in axial direction at one location 65 and 66, respectively, (see FIG. 2). The screens 68,

69 are connected only with the outermost relatively strong rings 33, 34, as shown in FIG. 3, for which purpose screws 70 are provided. A plurality of the screws 70 is employed over the circumference of the respective rings 33, 34.

Located within the screens 68, 69, slightly spaced radially therefrom by a distance of approximately 1 mm, there is mounted a pressing spindle 73 having a hub 74 on which screw flights 75–98 are mounted. The hub 74 is hollow in this embodiment and provided with openings 100 of which only a few are illustrated in FIG. 1. Expressed liquid can thus flow not only through the screens 68, 69 but also through the openings 100 into the interior of the hollow hub 74 to flow off therefrom. At the outer side of the screens 68, 69, the expressed liquid enters into the space between the screens 68, 69 and the outer jackets 28, 29 to run off in downward direction and to leave the center housing portion via an annular gap 103, to become collected in the lower housing portion 53 from which it is discharged. The liquid that travels into the interior of the hub 74 through the openings 100 flows downwardly in the interior of the hub 74 through an outlet 105 (see FIG. 6) in an outlet end 107 of the spindle 73. The outlet 105 communicates with the interior of a hollow tap 109 which is screw-threadedly connected at the outlet end 107 and which is supported via a radial slide bearing 110 on the lower housing portion 53. The interior of the tap 109, in turn, communicates with an outlet channel 112 which also receives the liquid that issues from the gap 103.

Flow-retarding members 114 and 115 (see FIG. 4) are arranged in two diametrically opposite axially parallel rows, being located between respective axially successive ones of the screw flights 75–98. The purpose of the members 114 and 115 is to retard the axial advancement of the chips by the spindle 73, which rotates relative to the housing 20, as much as possible in order to increase the time period during which they can be subjected to expressing of liquid. Each of the members 114, 115 is provided with a head plate 117 which is secured by means of four screws 119 (see FIG. 5) on a securing member 120 or 121 that is welded to the respectively associated outer jacket 28, 29. Small and flat reinforcing members 125 are welded intermediate the rings 33, 34 and the outer jackets 28, 29 in the planes of the members 114, 115.

The openings in the screens 68, 69 are not illustrated in FIG. 2 for the sake of simplicity. The screens 68, 69 will be seen to be provided in the region of their axial interruptions 65, 66 with an opening 127 for each of the members 114, the contour of the respective opening 127 being so selected that it permits the associated member 114 a small amount of play. The axial gaps or interruptions 65, 66 are bridged at the outer sides of the screens 68, 69 by respective members 129 and 130 which are each curved to conform to the contour of the outer side of the screens 68, 69. The abutting edges of the screens 68, 69 are drawn by screws 132 against the members 129, 130 (see FIG. 5), four of which screws 132 are grouped about the each respective opening 127. In the region of the members 129, 130 the rings 33, 34 are provided with appropriate cutouts 134.

Coming to the embodiment of FIG. 6, it will be seen that here the upper housing portion 45 has an upper end wall 140 provided with an exterior flange 141. The end wall 140 is sealed in gas and liquid-tight relationship with reference to the spindle 73 by means of a gland 143. Sugar beet or similar chips are admitted into the interior of the upper housing portion 45 by means of two chutes 145 and 146 each of which communicates with a relatively large opening 148 in the upper housing portion 45. The chips are then drawn in and precompressed by four screw flights 150–153 of relatively substantial pitch, each of which again has retarding members 155 associated with it.

A separate drive housing 160 is fixedly connected via a flange 157 to the flange 141. It has further flanges 161 and 162 on which there are removably mounted two diametrically opposite drive units 164 and 165, respectively. The units 164 and 165 each have a motor 167 and 168, respectively, as well as a planetary gear drive 170 and 171 driven by the respective motor and furnished with a pinion 173, 174. The pinions each mesh with a gear 175 that is mounted on a flange 177 of a hub 179 that is secured on the pressing spindle 73. The gear 175 is turnably journalled on the housing 160 in a manner to be described subsequently.

Figure 8:
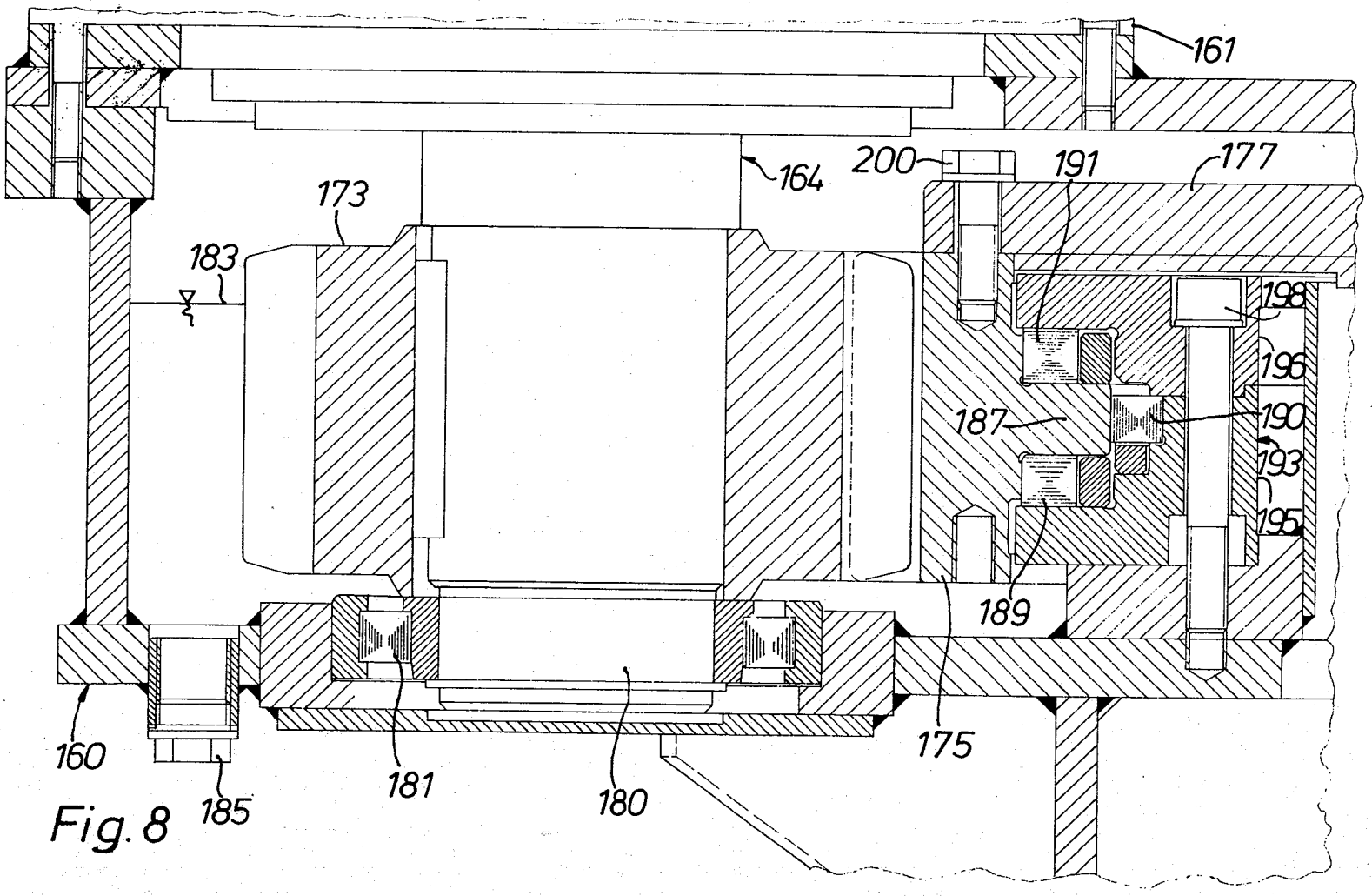
FIG. 8 is a fragmentary detail view in sectional view and on an enlarged scale, showing detail VIII of FIG. 6.

FIG. 8 shows that the free end of a drive shaft 180 supporting the pinion 173 and belonging to the drive unit 164 is turnably journalled on the housing 160 via a bearing 181. The housing 160 accommodates an oil bath that extends to an upper level 183 and which automatically lubricates all movable components present in the housing 160. The bottom of the housing 160 is formed with an oil discharge screw 185 that can be removed when oil is to be discharged.

The gear 175 is provided with a radially inwardly extending flange 187 having three free faces on which an annular set of rollers 189, 190, 191 of a combined radial and thrust bearing 193 rolls. The bearing 193 has a lower bearing ring 195 and an upper bearing ring 196 which are drawn axially together and against the housing 160 by a plurality of screws 198 that are distributed over the circumference of the bearing. The gear 175 is connected with a flange 177 by a plurality of circumferentially spaced screws 200.

Figure 9:
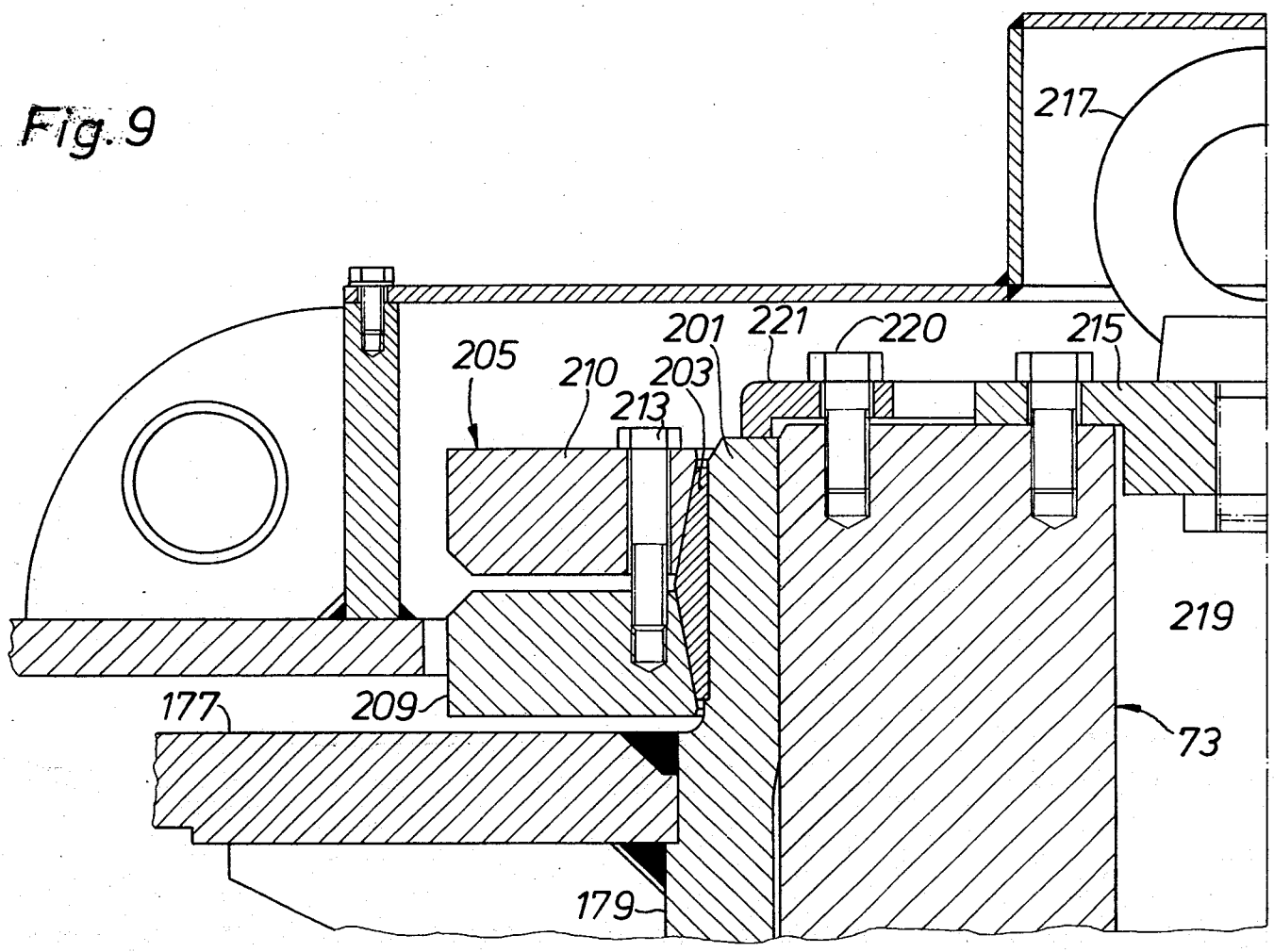
FIG. 9 is a further fragmentary enlarged sectional view showing detail IX of FIG. 6.

In the embodiment of FIG. 9, the flange 177 will be seen to be welded to the hub 179 the lower end of which rests on a radial shoulder (see FIG. 6) of the press spindle 73; the hub 179 is provided at the upper region with an inner non-slotted neck 201 which also engages the spindle 73. The outer side of the neck 201 is engaged by a non-slotted wedge ring 203 for a disc 205 having two tension rings 209, 210 which are drawn together by a plurality of screws 213 spaced over the circumference of the disc 205. The system composed of the neck 201 and the disc 205 is so constructed that when the disc 205 is tightened, the neck 201 is elastically deformed so that a sufficient frictional engagement exists between the neck 201 and the press spindle 73 to assure that the latter is driven in rotation without slippage.

A connecting member 215 connects a screw 217 with the upper end of the spindle 73; the purpose of the screw 217 is to aid in mounting and dismounting the spindle 73. The member 215 has the additional purpose of sealing from above a hollow 219 in the spindle 73. The upper end of the spindle 73 is further provided with a holding ring 221 that is secured by means of screws 220 and engages the upper side of the neck 201. The purpose of the ring 221 is to assure that the lower end of the hub 179 engages the press spindle shoulder before the disc 205 is tensioned. This prevents a relative axial displacement between the spindle 73 and the hub 179 when the press is in operation.

Figure 10:
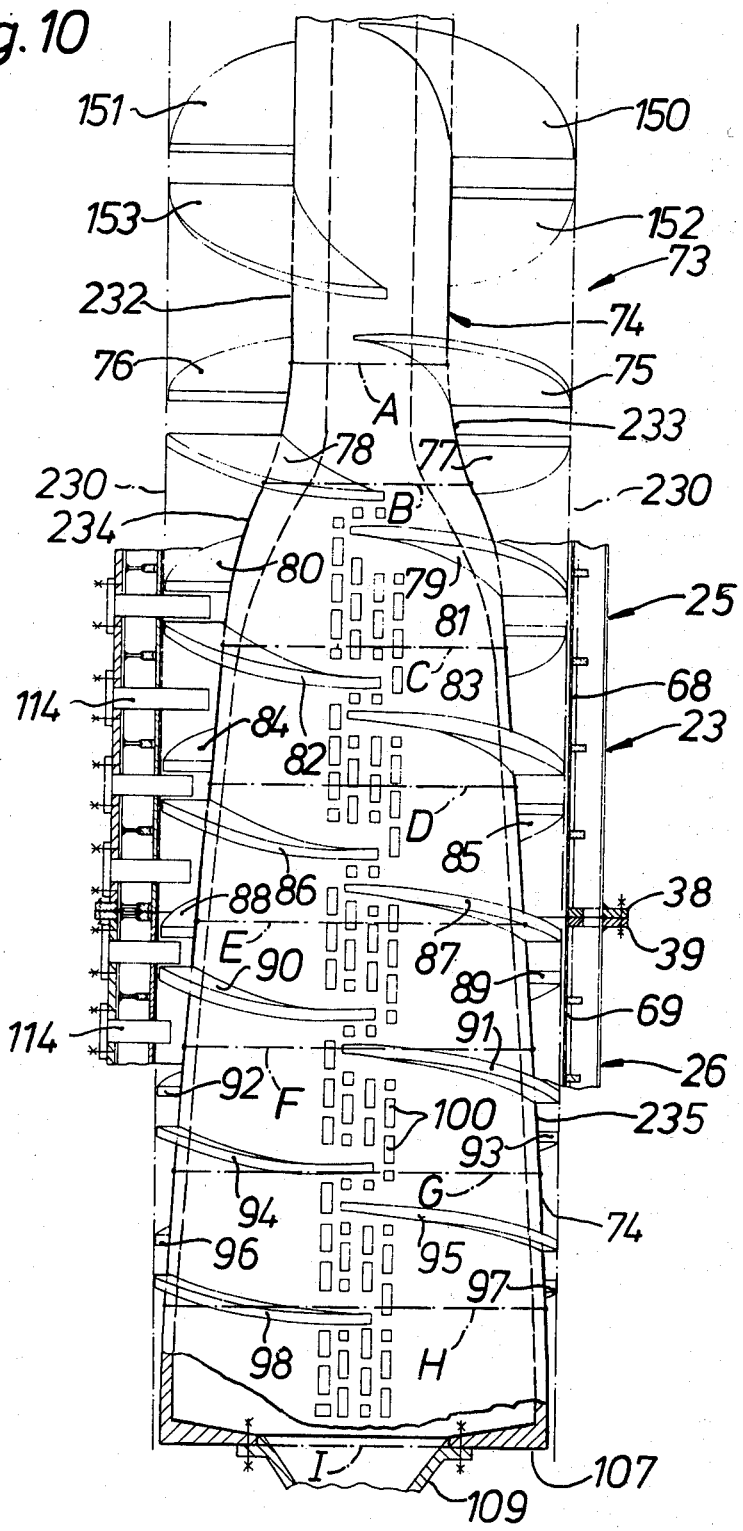
FIG. 10 is a fragmentary sectional side view of a spindle press according to a further embodiment of the invention.

FIG. 10 shows the components that have already been described. In addition, it shows a circular cross-sectional circumferential wall 230 which surrounds the press spindle 73 and is everywhere spaced by a small distance of approximately 1 mm from the screens 68, 69 of the center housing portion 23. The hub 74 of the spindle 73 has in its upper region a circular part 232 that extends to a transverse measuring circle or plane A, which part 232 is followed by a concave section 233 that extends to a similar region or circle B, and which is, in turn, followed by a convex section 234 that extends to a circle C, and an outwardly bowed section 235 which is located in a region intersected by measuring circles D, E, F, G, H and I. These circles A–I are not marked on the surface of the hub 74, but are only intended to furnish information concerning the dimensioning of the axial length of the respective sections.

It is advantageous if the measuring circles A–I are selected in accordance with the following table,

| Measuring region | Axial spacing from the outlet end (in %) | Radial spacing from the circumferential wall (in %) |
|---|---|---|
| A | 100.0 | 100 |
| B | 90.0 | 65–93 |
| C | 74.9 | 35–60 |
| D | 62.4 | 26–53 |
| E | 49.8 | 16–44 |
| F | 37.2 | 11–33 |
| G | 24.6 | 7–23 |
| H | 11.8 | 3–14 |
| I | 0.0 | 3–9 |

and if the concave section is located between the regions A and B, the convex section between the regions B and C, and the bowed section between the regions C and I. This arrangement produces a significant increase in the effectiveness of expressing of liquid from the chips.

According to a further embodiment of the invention, the spindle may be constructed so that the sections are located with reference to the measuring circles A–I in accordance with the following table:

| Measuring region | Axial spacing from the outlet end (in %) | Radial spacing from the circumferential wall (in %) |
|---|---|---|
| A | 100.0 | 100.00 |
| B | 90.0 | 79.20 |
| C | 74.9 | 49.60 |
| D | 62.4 | 40.00 |
| E | 49.8 | 30.35 |
| F | 37.2 | 22.05 |
| G | 24.6 | 15.18 |
| H | 11.8 | 8.26 |
| I | 0.0 | 6.06 |

This embodiment affords a particularly high effectiveness in expressing liquid from the chips.

The construction with respect to FIGS. 1–5 is a particularly strong and stiff construction and is nevertheless light in weight; it can be produced with a high degree of accuracy. In particular, the end faces of the housing sections and the surfaces of the holding rings which engage the screens can be produced with the necessary accuracy on existing machinery.

Insofar as the drives for the spindle are concerned, they may utilize a motor or a motor-gear arrangement in the various embodiments of the invention.

It will be understood that each of the elements described above, or two or more together, may also find a useful application in other types of constructions differing from the type described above.

While the invention has been illustrated and described as embodied in a press for sugar beet and similar chips, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a press for sugar beet and similar chips, a combination comprising a pressing spindle rotatable about an upright axis; a housing surrounding said pressing spindle and having an upper section, a lower section and a middle section, said middle section including a self-supporting outer jacket and a tubular screen received with radial clearance in said outer jacket; means for mounting said screen on said outer jacket, including contacting portions embracing the outer surface of said screen, and means for securing said contacting portions to said outer jacket inwardly spaced therefrom; means for connecting said outer jacket with said upper and lower housing sections, respectively; and means for rotating said spindle about said upright axis and including a drive mounted on said upper section of said housing.

2. In a press for sugar beet and similar chips, a combination comprising a rotatable pressing spindle; a housing surrounding said pressing spindle and having an upper section, a lower section and a middle section, said middle section including a self-supporting outer jacket and a tubular screen received with radial clearance in said outer jacket; mounting elements on said outer jacket, extending inwardly thereof and mounting said screen on said outer jacket and including projecting portions mounted on said outer jacket, and ring portions secured to said projecting portions and contacting the outer surface of said screen, surrounding the latter and being coaxial with a longitudinal axis of said middle section of said housing; and means for connecting said outer jacket with said upper and lower housing sections, respectively.

3. A combination as defined in claim 2, wherein said projecting portions are angularly spaced about said screen and each have a dimension which extends parallel to said longitudinal axis.

4. A combination as defined in claim 2; and further comprising releasable securing means releasably securing said screen to at least one of said ring portions.

5. In a press for sugar beet and similar chips, a combination comprising a press housing; a rotatable pressing spindle having a first portion journalled in said press housing, and an upwardly extending second portion; a separate drive housing into which said second portion projects; connecting means releasably connecting said drive housing with said press housing; a hub mounted on said second portion of said spindle and having a radially outwardly extending flange; a gear annulus mounted on said flange and having gear teeth at one side thereof; at least one bearing intermediate said drive housing and the opposite side of said gear annulus; and at least one drive unit mounted on said drive housing and having a pinion meshing with said gear teeth of said gear annulus.

6. A combination as defined in claim 5, wherein said bearing is a combined radial and thrust bearing which engages said other side of said gear.

7. A combination as defined in claim 5, said press housing having an opening through which said end portion of said spindle extends; and further comprising sealing means for sealing said opening against the passage of fluids.

8. A combination as defined in claim 5, and further comprising at least one additional drive unit similar to said drive unit and spaced therefrom in the circumferential direction of said gear annulus.

9. In a press for sugar beet and similar chips, a combination comprising a press housing having a circumferential wall and being provided with a chip inlet and an axially spaced outlet; and a rotatable pressing spindle journalled for rotation in said housing and being spaced over its entire length from said circumferential wall, said spindle having a first part of circular cross section in the region of said inlet, and a second part which extends from said first part towards said outlet and increases in diameter in direction towards said outlet, said second part having in direction from said first part towards said outlet a concave portion followed by a convex portion which is followed by an outwardly bowed portion, wherein imaginary measuring regions which extend across the outer surface of said second part at right angles to the spindle axis have the following parameters:

| Measuring region | Axial spacing from said outlet end (in %) | RAdial spacing from said circumferential wall (in %) |
|---|---|---|
| A | 100.0 | 100 |
| B | 90.0 | 65–93 |
| C | 74.9 | 35–60 |
| D | 62.4 | 26–53 |
| E | 49.8 | 16–44 |
| F | 37.2 | 11–33 |
| G | 24.6 | 7–23 |
| H | 11.8 | 3–14 |
| I | 0.0 | 3–9 |

and wherein said concave portion is located between the regions A and B, said convex portion is located between the regions B and C and said bowed portion is located between the regions C and *l*.

10. A combination as defined in claim 9, wherein said regions A to I have the following parameters:

| Measuring region | Axial spacing from said outlet end (in %) | Radial spacing from said circumferential wall (in %) |
|---|---|---|
| A | 100.0 | 100.00 |
| B | 90.0 | 79.20 |
| C | 74.9 | 49.60 |
| D | 62.4 | 40.00 |
| E | 49.8 | 30.35 |
| F | 37.2 | 22.05 |
| G | 24.6 | 15.18 |
| H | 11.8 | 8.26 |
| I | 0.0 | 6.06 |

11. A combination as defined in claim 1, wherein said middle section is divided transversely to its longitudinal axis into at least two sections connectible with each other by connecting means.

12. In a press for sugar beet and similar chips, a combination comprising a press housing; a drive housing; connecting means releasably connecting said drive housing with said press housing; means subdividing said drive housing into a central compartment and an annular compartment surrounding said central compartment; a pressing spindle having a first portion journalled in said press housing for rotation about an upright axis, and a second portion extending upwardly from said first portion into said central compartment of said drive housing; and means for supporting said pressing spindle in said drive housing and for rotating the same, including a gear annulus accommodated in said annular compartment, a bearing mounting said gear annulus in said annular compartment for rotation about said upright axis, a hub mounted on said second portion of said pressing spindle for shared rotation therewith, a flange interconnecting said hub with said gear annulus and extending between said central and annular compartments, and at least one drive unit removably connected with said drive housing and having a pinion meshing with said gear annulus.

* * * * *